US008375660B2

(12) United States Patent
Nolan et al.

(10) Patent No.: US 8,375,660 B2
(45) Date of Patent: Feb. 19, 2013

(54) INTERLOCKING DECORATIVE TRIM SYSTEM

(75) Inventors: Patrick Nolan, Royersford, PA (US); Michael A. Dotsey, Pottstown, PA (US)

(73) Assignee: AZEK Building Products, Inc., Scranton, PA (US)

( * ) Notice: Subject to any disclaimer, the term of this patent is extended or adjusted under 35 U.S.C. 154(b) by 258 days.

(21) Appl. No.: 12/986,483

(22) Filed: Jan. 7, 2011

(65) Prior Publication Data

US 2012/0174514 A1 Jul. 12, 2012

(51) Int. Cl.
*E04F 19/02* (2006.01)
*E06B 1/30* (2006.01)

(52) U.S. Cl. ..... 52/211; 52/204.53; 52/204.54; 52/212; 52/287.1; 52/717.01; 52/656.9; 52/578; 52/836; 52/845

(58) Field of Classification Search ..... 52/204.53, 52/204.54, 211, 212, 287.1, 288.1, 717.01, 52/656.2, 656.4, 656.5, 656.9, 836, 844, 52/845, 847, 578, 588.1, 574
See application file for complete search history.

(56) References Cited

U.S. PATENT DOCUMENTS 5,134,250 A * 7/1992 Caveney et al. ..... 174/101
5,850,717 A * 12/1998 Schiedegger et al. ..... 52/288.1
5,881,508 A * 3/1999 Irvine et al. ..... 52/177
6,050,037 A * 4/2000 Gifford ..... 52/211
6,125,607 A * 10/2000 Poce ..... 52/847
6,807,783 B2 * 10/2004 Lee ..... 52/473
6,903,265 B1 * 6/2005 VanderVelde et al. ..... 174/481
2002/0018907 A1 2/2002 Zehner
2002/0059760 A1 5/2002 Heard et al.
2003/0046891 A1 3/2003 Colada et al.
2004/0182040 A1 * 9/2004 Schiedegger et al. ..... 52/717.01
2005/0262798 A1 * 12/2005 Pringle et al. ..... 52/718.04
2006/0096203 A1 * 5/2006 Weinstein ..... 52/288.1
2010/0043312 A1 2/2010 Chich et al.
2010/0058691 A1 3/2010 Mannion

* cited by examiner

*Primary Examiner* — Robert Canfield

(74) *Attorney, Agent, or Firm* — Buchanan Ingersoll & Rooney PC

(57) ABSTRACT

An interlocking decorative trim system has a backing strip and a cover strip interlocked together. The backing strip has a top, a bottom, a back face, a front face, a tongue extending from the top, and a projection adjacent the bottom and extending away from the front face. The front face has a recess and the projection has a slot. The cover strip has a top, a bottom, a front face, a back face, a tab extending from the bottom, and a second projection adjacent the top and extending away from the front face. The back face has a recess and the second projection has a groove. The tongue of the backing strip fits inside the groove of the cover strip and the tab of the cover strip fits into the slot of the backing strip.

19 Claims, 6 Drawing Sheets

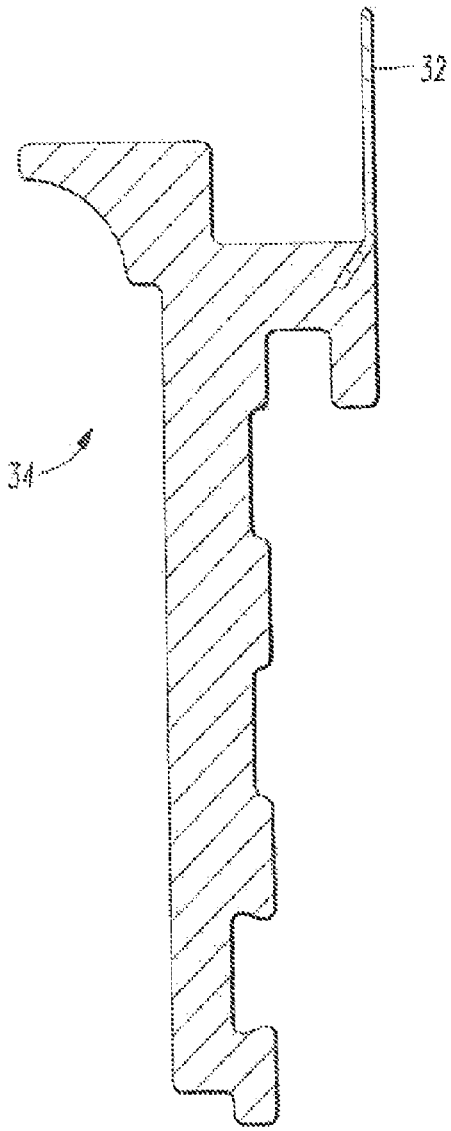
FIG.5
FIG.6
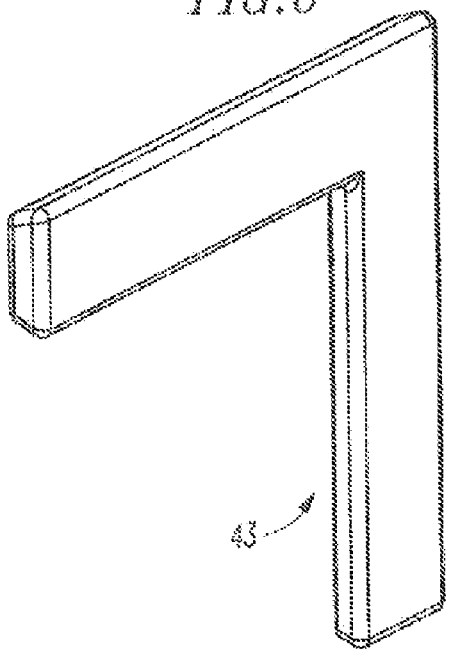

INTERLOCKING DECORATIVE TRIM SYSTEM

BACKGROUND OF THE INVENTION

1. Field of the Invention

The present invention relates to improvements in trim components and trim assemblies.

2. Description of the Related Art

Trim assemblies are used in a variety of applications to frame doorways, windows, patio doors, garage doors etc., in order to provide a decorative frame for such areas of a house or other structure. Recently, these assemblies have been manufactured from plastics such as high-density polyurethane and other alternatives to natural wood.

In general, plastics provide significant advantages over natural wood. Door trim assemblies or other components manufactured from plastic can be low in maintenance when compared with natural wood. Plastic trim assemblies are nearly impervious to moisture and therefore will not rot or decay like natural wood.

Plastic trim assemblies or components thereof can be used in construction just like natural wood. Further, during the manufacture of plastic trim assemblies, plastic can be tinted with dyes or other materials to provide a specific color to a component, thus removing the need for surface preparation and painting prior to or subsequent to installing the trim assembly.

Prior trim assemblies have also typically required the various components comprising the assembly to be secured directly to the structure via nails, threaded fasteners, or other hardware. Most typically, the trim components use one or more flanges that has a number of apertures through which the nails or screws are driven to secure a trim component to the structure.

While generally effective in securing the various trim components to a structure, the requirement of nails or other fastening elements can add to the time and expense associated with installing the complete trim assembly. Also, there may be times when flanges cannot be used and the trim components must be fastened to a structure, such as by placing a fastener through the exterior or visible face of the trim. Because these fasteners may be visible from the exterior face of the trim, further work may be required to achieve a decorative appearance.

Moreover, water damage is exacerbated when trim components are securely fastened to a structure. Often times there is little room remaining inside a trim assembly and as water is retained within crevices of the trim assembly, freezing and thawing cycles cause further deterioration of the trim assembly. Thus there is a need for a trim system that is easy to manufacture and install, and allows for expansion and contraction of small amounts of water from within or around the trim pieces while still providing a decorative surface.

SUMMARY OF THE INVENTION

An interlocking decorative trim system that has a cover strip that interlocks with a backing strip in a window frame or other trim is disclosed herein. The cover strip and backing strip are configured to interlock using tongue and groove joints such that the cover strip obscures any nail holes or other fasteners used in applying the backing strip. Gaps are provided in the joints between the two parts to allow for thermal expansion of the parts and allow for engineering tolerances. In addition, recesses are provided that allow for the heads of fasteners to be hidden or countersunk so that there are not problems with alignment when fasteners are used to attach the backing strip to a house or building. These recesses also allow for thermal expansion in the cover strip and the backing strip. The recesses may also help to avoid problems with water expansion and contraction in between the backing strip and the cover strip. Further, the recesses provide proper manufacturing requirements to prevent warping of the components during manufacturing.

An interlocking decorative trim system preferably comprises a backing strip and a cover strip, both of which are preferably made from cellular polyvinyl chloride (PVC). The backing strip has a top, a bottom, a back face, a front face, a tongue extending from the top, and a projection adjacent the bottom and extending away from the front face. The front face has at least one recess and the projection has a slot. The cover strip has a top, a bottom, a front face, a back face, a tab extending from the bottom, and a second projection adjacent the top and extending away from the front face. The back face has at least one recess and the second projection has a groove. The tongue of the backing strip is located inside the groove of the cover strip and the tab of the cover strip located inside the slot of the backing strip to interlock the backing strip and the cover strip together.

In another preferred embodiment an interlocking decorative trim assembly comprises a first and a second backing strip, a first and a second cover strip, and a right angle reinforcement. The first and second backing strip each has a top, a bottom, a first end, a second end, a back face, a front face, a tongue extending from the top, and a projection adjacent the bottom and extending away from the front face. The front face has at least one recess and the projection has a slot.

Additionally, the first and second cover strip each has a top, a bottom, a first end, a second end, a front face, a back face, a tab extending from the bottom, and a second projection adjacent the top and extending away from the front face. The back face has at least one recess, and the second projection has a groove. The right angled reinforcement is sized and configured to fit into at least one recess of a cover strip.

Further, the tongue of the first backing strip is located inside the groove of the first cover strip and the tab of the first cover strip located inside the slot of the first backing strip. The tongue of the second backing strip is located inside the groove of the second cover strip and the tab of the second cover strip located inside the slot of the second backing strip. The first end of the first cover strip is located adjacent to the first end of the second cover strip and the first end of the first backing strip is located adjacent to the first end of the second backing strip. A portion of the right angled reinforcement is located inside the at least one recess of the first cover strip and a portion of the right angled reinforcement is located inside the at least one recess of the second cover strip such that the first and second cover strip are held in a mated or substantially mated condition.

In another embodiment an interlocking decorative trim assembly comprises a first, a second, and a third backing strip, a first, a second, and a third cover strip, and a first and a second right angle reinforcement. The first, second, and third backing strip each has a top, a bottom, a first end, a second end, a back face, a front face, a tongue extending from the top, and a projection adjacent the bottom and extending away from the front face. The front face has at least one recess and the projection has a slot. The first, second, and third cover strip each has a top, a bottom, a first end, a second end, a front face, a back face, a tab extending from the bottom, and a second projection adjacent the top and extending away from the front face. The back face has at least one recess, and the second projection has a groove.

Additionally, the first and second right angled reinforcement are each sized and configured to fit into at least one recess of a cover strip. The tongue of the first backing strip is located inside the groove of the first cover strip and the tab of the first cover strip located inside the slot of the first backing strip. The tongue of the second backing strip is located inside the groove of the second cover strip and the tab of the second cover ship located inside the slot of the second backing strip. The tongue of the third backing strip is located inside the groove of the third cover strip and the tab of the third cover strip located inside the slot of the third backing strip. The first end of the first cover strip is located adjacent to the first end of the second cover strip.

Further, the first end of the first backing strip is located adjacent to the first end of the second backing strip. The second end of the second cover strip is located adjacent to the first end of the third cover strip. The second end of the second backing strip is located adjacent to the first end of the third backing strip. A portion of the first right angled reinforcement is located inside the at least one recess of the first cover strip and a portion of the first right angled reinforcement is located inside the at least one recess of the second cover strip such that the first and second cover strip are held in a mated or substantially mated condition. A portion of the second right angled reinforcement is located inside the at least one recess of the second cover strip and a portion of the second right angled reinforcement is located inside the at least one recess of the third cover strip such that the second and third cover strip are held in a mated or substantially mated condition. This embodiment may be used around a doorway.

In another embodiment that can be used around a window an interlocking decorative trim assembly comprises a first, a second, a third, and a fourth backing strip, a first, a second, a third, and a fourth cover strip, and a first, a second, a third, and a fourth right angle reinforcement. The first, second, third, and fourth backing strip each has a top, a bottom, a first end, a second end, a back face, a front face, a tongue extending from the top, and a projection adjacent the bottom and extending away from the front face. The front face having at least one recess and the projection has a slot.

In addition, the first, second, third, and fourth cover strip each has a top, a bottom, a first end, a second end, a front face, a back face, a tab extending from the bottom, and a second projection adjacent the top and extending away from the front face. The back face has at least one recess, and the second projection has a groove. The first, second, third, and fourth right angled reinforcement are each sized and configured to fit into the at least one recess of a cover strip.

Further, the tongue of the first backing strip is located inside the groove of the first cover strip and the tab of the first cover strip located inside the slot of the first backing strip. The tongue of the second backing strip is located inside the groove of the second cover strip and the tab of the second cover strip located inside the slot of the second backing strip. The tongue of the third backing strip is located inside the groove of the third cover strip and the tab of the third cover strip located inside the slot of the third backing strip. The tongue of the fourth backing strip is located inside the groove of the fourth cover strip and the tab of the fourth cover strip located inside the slot of the fourth backing strip.

Additionally, the first end of the first cover strip is located adjacent to the first end of the second cover strip and the first end of the first backing strip is located adjacent to the first end of the second backing strip. The second end of the second cover strip is located adjacent to the first end of the third cover strip and the second end of the second backing strip is located adjacent to the first end of the third backing strip. The second end of the third cover strip is located adjacent to the second end of the fourth cover strip and the second end of the third backing strip is located adjacent to the second end of the fourth backing strip. The first end of the fourth cover strip is located adjacent to the second end of the first cover strip and the first end of the fourth backing strip is located adjacent to the second end of the first backing strip; and Moreover, a portion of the first right angled reinforcement is located inside the at least one recess of the first cover strip adjacent the first end and a portion of the first right angled reinforcement is located inside the at least one recess of the second cover strip adjacent the first end such that the first and second cover strip are held in a mated or substantially mated condition. A portion of the second right angled reinforcement is located inside the at least one recess of the second cover strip adjacent the second end and a portion of the second right angled reinforcement is located inside the at least one recess of the third cover strip adjacent the first end such that the second and third cover strip are held in a mated or substantially mated condition.

Furthermore, a portion of the third right angled reinforcement is located inside the at least one recess of the third cover strip adjacent the second end and a portion of the third right angled reinforcement is located inside the at least one recess of the fourth cover strip adjacent the second end such that the third and fourth cover strip are held in a mated or substantially mated condition. A portion of the fourth right angled reinforcement is located inside the at least one recess of the fourth cover strip adjacent the first end and a portion of the fourth right angled reinforcement is located inside the at least one recess of the first cover strip adjacent the second end such that the fourth and first cover strip are held in a mated or substantially mated condition.

In another preferred embodiment the interlocking decorative trim system further includes a flange extending from the top of the cover strip.

In another preferred embodiment the flange and the top of the cover strip define a cavity sized to receive siding.

In yet another preferred embodiment the flange has a plurality of apertures to allow the backing strip to be fastened to a wall.

In another preferred embodiment the flange is made from rigid PVC and the cover strip is made from cellular PVC.

In another preferred embodiment the tongue and the groove are sized such that a channel is formed between the tongue and the groove.

In another preferred embodiment the at least one recess of the backing strip is sized and configured to accommodate a fastener such that the fastener does not extend out of the recess in a direction away from the front face of the backing strip.

In another preferred embodiment the at least one recess of the backing strip is longitudinal and extends a length of the backing strip.

Other details, objects, and advantages of the invention will become apparent as the following description of certain present preferred embodiments thereof proceeds.

BRIEF DESCRIPTION OF THE FIGURES

In the accompanying drawing I have shown certain present preferred embodiments of our window covering in which:

FIG. 5 is an end view similar to FIG. 1 of a second present preferred embodiment of the cover strip of our interlocking decorative trim system.

FIG. 6 is a front perspective view of a right angled reinforcement of our interlocking decorative trim assembly.

DESCRIPTION OF THE PREFERRED EMBODIMENTS

Figure 1:
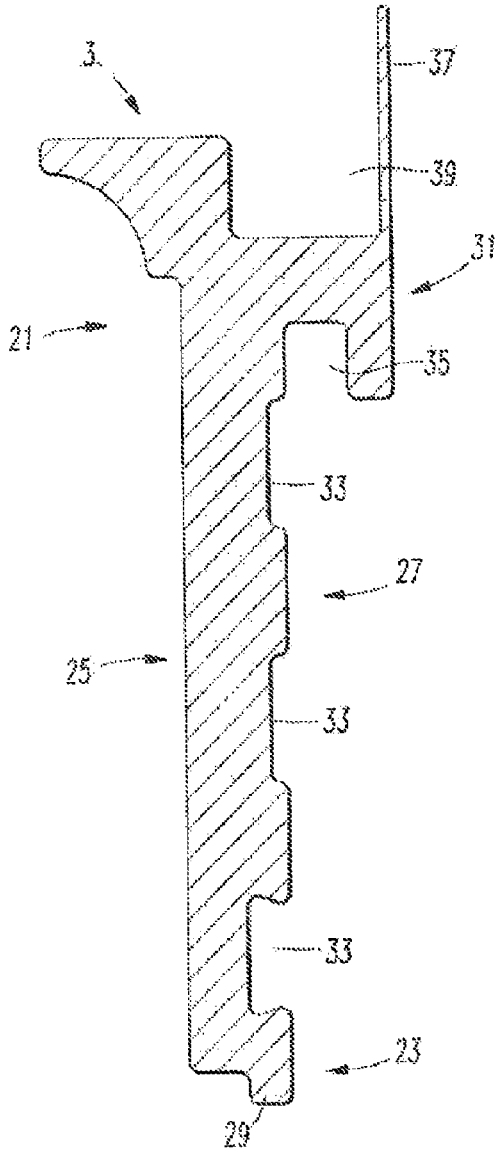
FIG. 1 is an end view of a present preferred embodiment of the cover strip of our interlocking decorative trim system.
Figure 2:
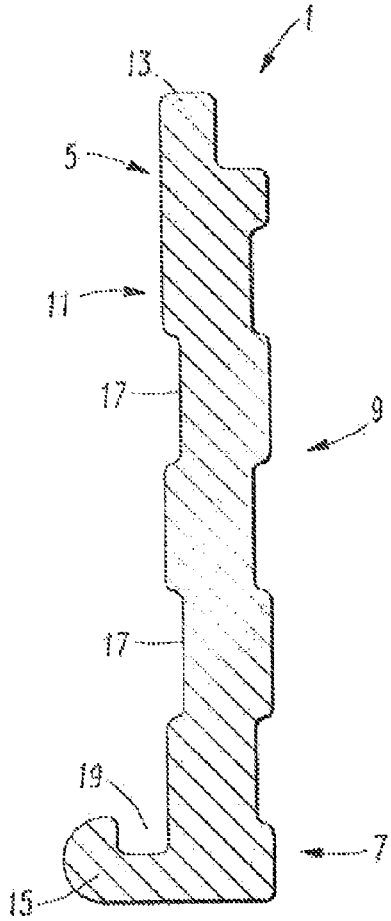
FIG. 2 is an end view of a present preferred embodiment of the backing strip of our interlocking decorative trim system.

Referring to FIGS. 1-4, our interlocking decorative trim system 2 has a backing strip 1 and a cover strip 3. The backing strip 1 has a top 5, a bottom 7, a back face 9, a front face 11, a tongue 13 extending from the top 5, and a projection 15 adjacent the bottom 7 and extending away from the front face 11. The front face 11 has at least one recess 17 and the projection has a slot 19. The cover strip 3 has a top 21, a bottom 23, a front face 25, a back face 27, a tab 29 extending from the bottom 23, and a second projection 31 adjacent the top 21 and extending away from the front face 25. The back face 27 has at least one recess 33 and the second projection has a groove 35.

The backing strip 1 and the cover strip 3 may be manufactured from the same material or different materials depending upon the desire of a user and the requirements of the particular installation. The backing strip and the cover strip may be manufactured from various materials, including wood plastic composites, polyurethane, cellular PVC, and aluminum. In addition the backing strip 1 and the cover strip 3 may be manufactured through routing, molding, extrusion, or any other suitable manufacturing technique.

Figure 3:
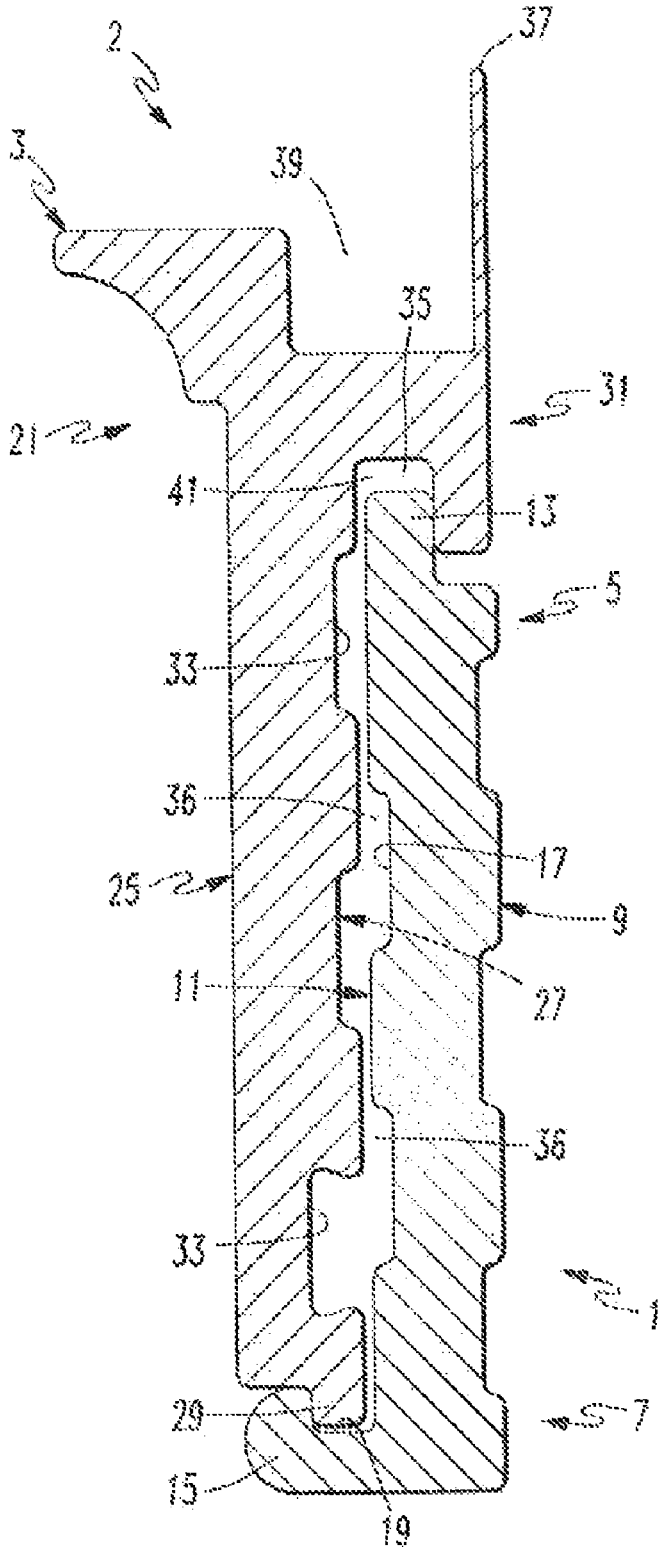
FIG. 3 an end view of the backing strip shown in FIG. 2 and the cover strip shown in FIG. 1 interlocked to form our decorative trim system.
Figure 4:
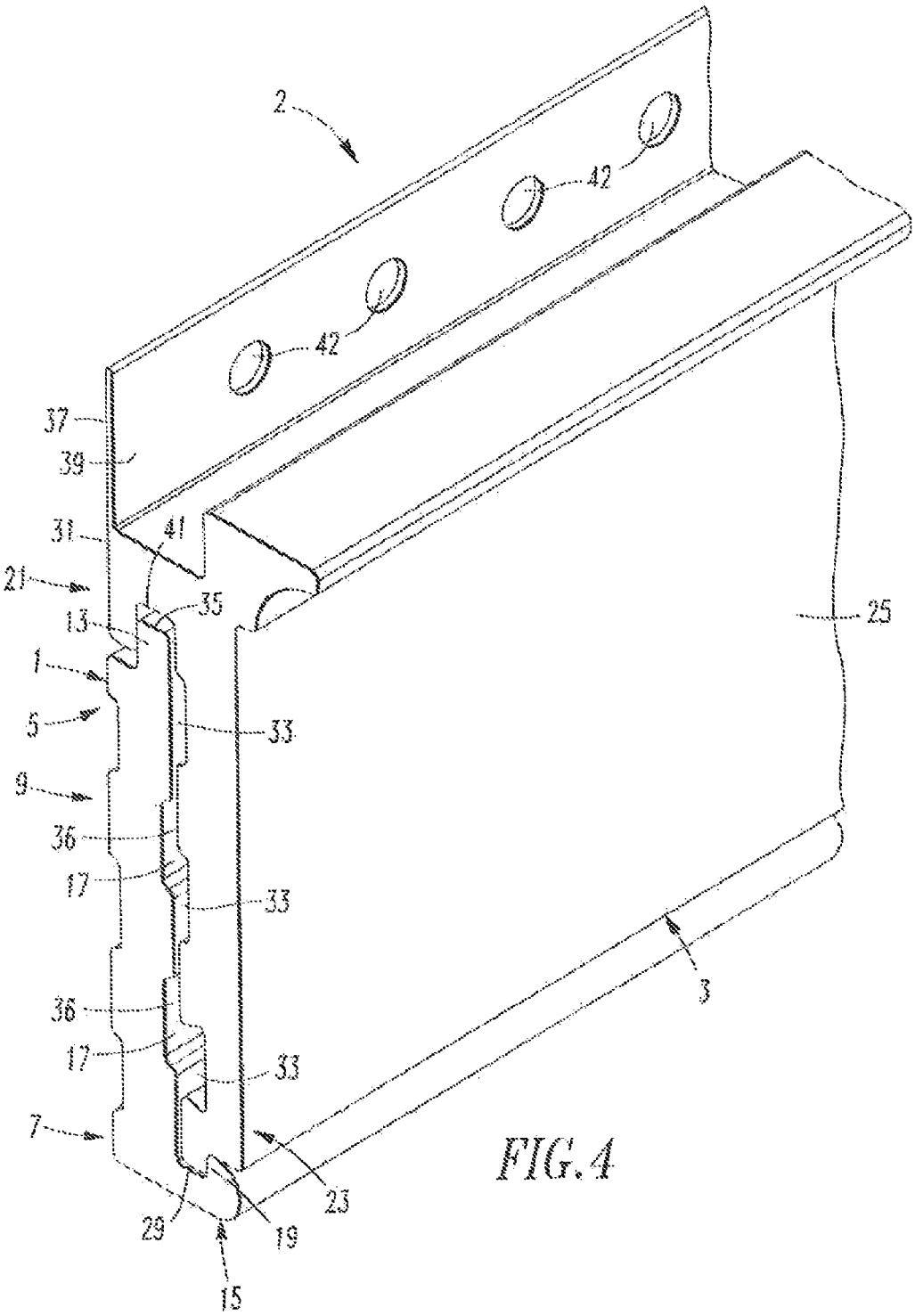
FIG. 4 is a front perspective view of the interlocking decorative trim system shown in FIG. 3.

When the backing strip and the cover strip are interlocked together as shown in FIGS. 3 and 4 the tongue 13 of the backing strip 1 is located inside the groove 35 of the cover strip 3 and the tab 29 of the cover strip 3 is located inside the slot 19 of the backing strip 1. When installed, the backing strip 1 and the cover strip 3 may be firmly bonded by placing an adhesive inside the groove 35 and the slot 19 prior to interlocking the backing strip and the cover strip. Any adhesive suitable for use with the material from which of the backing strip and the cover strip are made should be used. For example, PVC cement should be used when the two strips are made of PVC.

Those skilled in the art will recognize that shapes other than those shown in the drawings may be used for tongue 13 and groove 35 and the tab 29 and slot 19. For example, the tongue 13 may be thinner and a shoulder may be provided between the groove 35 and the rear face 37. Having a cover strip that interlocks with a backing strip using a tongue and a groove and a tab and a slot permits easy installation of the interlocking decorative trim system. Mechanical tools are not necessary for installing the cover strip.

Further, the front face of the cover strip may be formed to have various decorative features. Because there is no need for a fastener to be placed through the cover strip, there are no nail heads or fastener holes on the face of the trim. A backing strip may be used with a specific design of cover strip. The cover strip may have a different front face based on an owner's desire or need. This may allow a retailer to offer a wide variety of decorative trims. In addition, the cover strip can be prefinished, formed, or manufactured from a dyed material such that the front face of the cover strip will remain unmarked and will not require any other surface preparation or coaling.

The tongue 13 and the groove 35 should be sized such that a channel or passageway 41 is formed between the tongue 13 and the groove 35. The passageway 41 provides space between the backing strip 1 and the cover strip 3 so that the backing strip and the cover strip may be manufactured within a certain engineering tolerance.

The recess or recesses 17 in the backing strip 1 may be aligned with or partially offset from the recesses 33 of the cover strip 3. The recess or recesses allow for manufacturing tolerances and also may prevent the components from warping when made by extrusion as they are being manufactured. Furthermore, any water that may penetrate the backing strip and the cover strip should collect in a recess such that if the water freezes it will not cause the two strips to separate.

We prefer to provide a flange 37 extending from the top 21 of the cover strip 3. The flange 37 and the top 21 of the cover strip 3 may define a cavity 39 that is sized and configured to receive a piece of siding. The flange 37 also may have a plurality of apertures 42 lo allow the backing strip 1 to be easily fastened to a wall. One may choose not to provide either that flange 37 or the cavity 39.

In another preferred embodiment of the present invention as shown in FIG. 5, the cover strip 34 and the flange 32 may be made from different materials, for example the flange 32 is made from rigid PVC and the cover strip 34 is made from cellular PVC.

Figure 7:
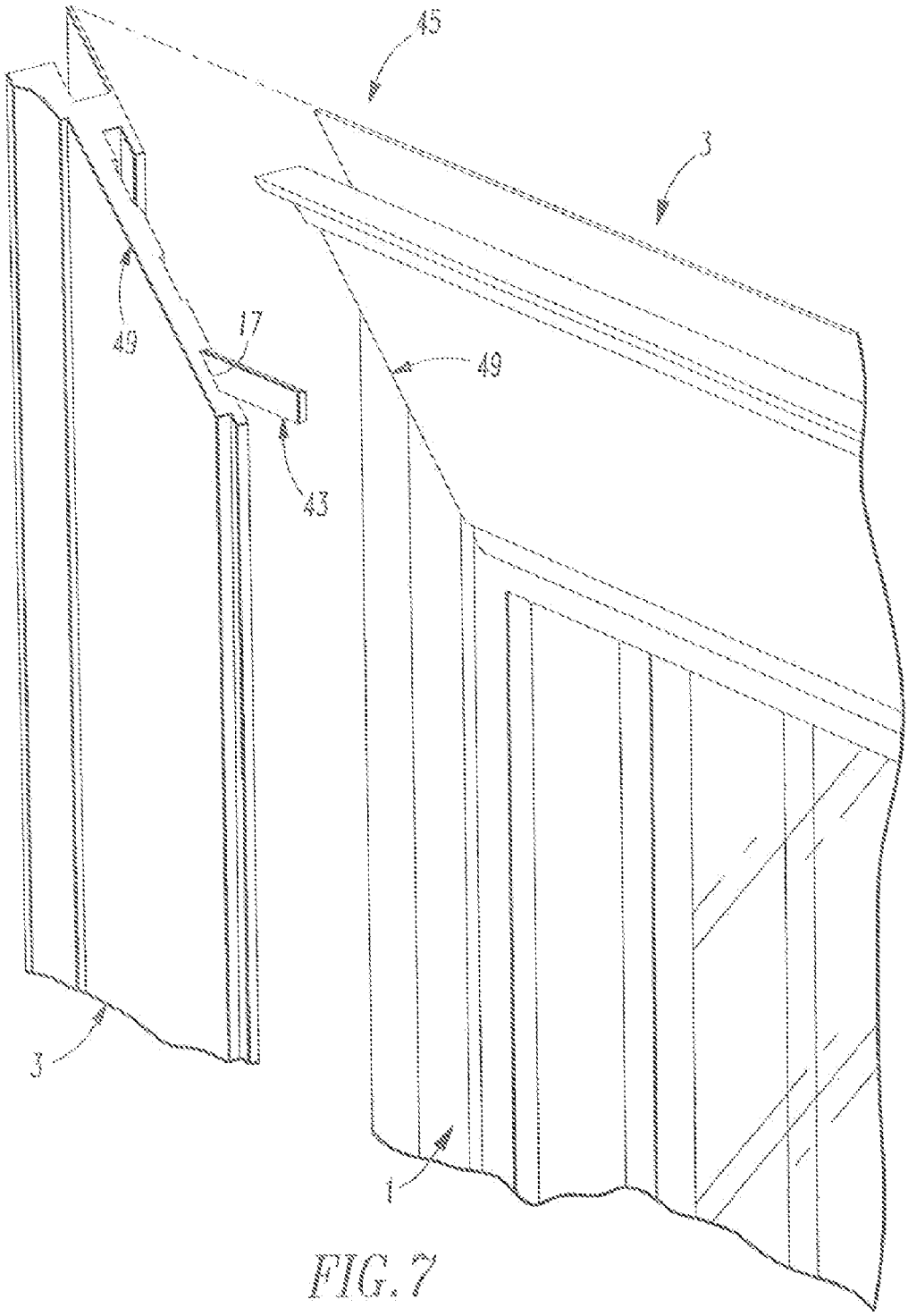
FIG. 7 is a front perspective view of an embodiment of our interlocking trim assembly showing a first cover strip located adjacent to a second cover strip.

In another preferred embodiment of the present invention as shown in FIG. 7 an interlocking decorative trim assembly 45 has a first and a second backing strip 1 a first and a second cover strip 3, and a right angle reinforcement 43 (the first backing strip being behind a cover strip). A preferred embodiment of the right angled reinforcement 43 is shown in FIG. 6. The right angled reinforcement 43 is sized and configured to fit into at least one recess 17 of each cover strip 3.

The second cover strip 3 is shown disassembled from the second backing strip 1 for illustration purposes. A portion of the right angled reinforcement 43 is located inside the at least one recess 17 of the second cover strip 3 and a portion of the right angled reinforcement 43 may be located inside the at least one recess 17 of the first cover strip 3. The edges of the first cover strip 3 and the second cover strip 3 may be held in a mated or substantially mated condition such that the joint is flush. The edges or ends 49 of the cover strips 3 may be cut or manufactured to be forty-five degrees or substantially thereof to allow for easy alignment and a flush abutment of a cover strip 3 with another cover strip 3.

Figure 8:
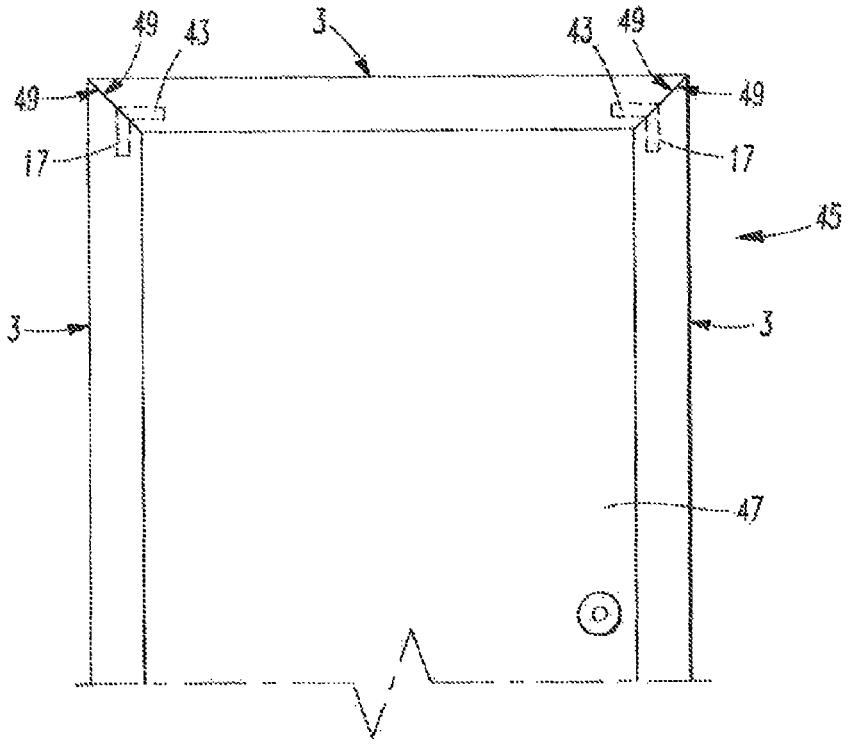
FIG. 8 is a front view of another embodiment of our interlocking trim assembly installed around a door.

FIG. 8 shows the interlocking decorative trim assembly 45 of FIG. 7 installed around a door. The interlocking decorative trim assembly 45 has a first, a second, and a third backing strip behind a first, a second, and a third cover strip 3. A first and a second right angle reinforcement 43 interlock adjacent cover strips 3. The ends 49 of the cover strips 3 and the backing strips are located adjacent each other, and the right angle reinforcements 43 are located in the recesses 17 of the cover strips 3 such that the right angle reinforcements 43 hold the cover strips 3 in mated or substantially mated condition to each other. The backing strips are attached to a wall.

Figure 9:
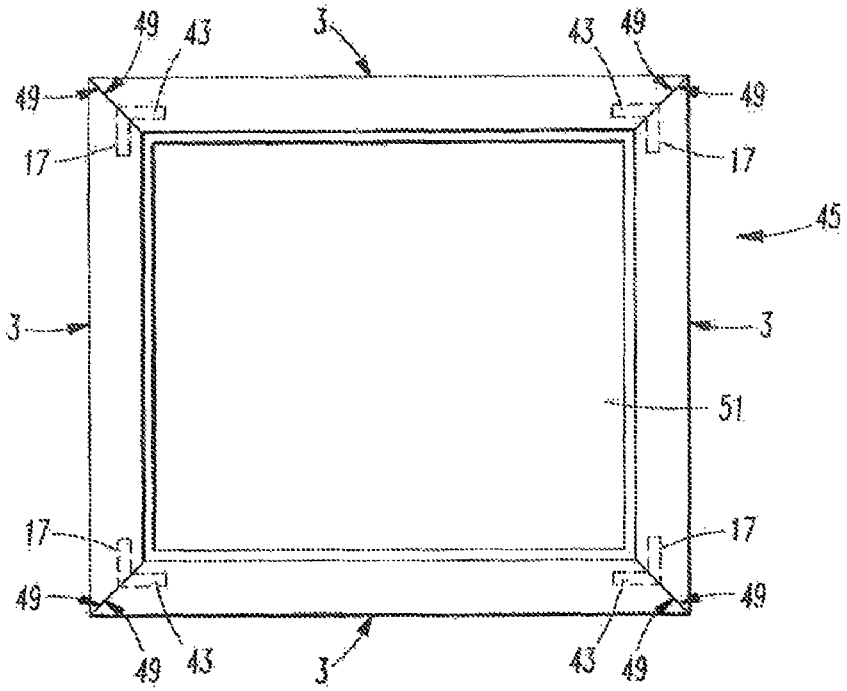
FIG. 9 is a front view of another embodiment of our interlocking trim assembly installed around a window.

Similar to FIG. 8, FIG. 9 shows the interlocking decorative trim assembly 45 installed around a window 51. The interlocking decorative trim assembly 45 has a first, a second, a third, and a fourth backing strip behind a first, a second, a third, and a fourth cover strip 3. The ends 49 of the cover strips 3 and the backing strips are located adjacent each other, and right angle reinforcements 43 are located in the recesses 17 of the cover strips 3 such that the right angle reinforcements 43 hold the cover strips in mated or substantially mated condition to each other.

While we have shown and described certain present preferred embodiments of our interlocking decorative trim system and have illustrated certain present preferred methods of making and using the same, it is to be distinctly understood that the invention is not limited thereto but may be otherwise variously embodied and practiced within the scope of the following claims.

We claim:

1. An interlocking decorative trim system comprising a backing strip and a cover strip; wherein the backing strip has a top, a bottom, a back face, a front face, a tongue extending from the top, and a projection adjacent the bottom and extending away from the front face, the front face having at least one recess and the projection having a slot; and the cover strip having a top, a bottom, a front face, a back face, a tab extending from the bottom, and a second projection adjacent the top and extending away from the front face, the back face having at least one recess and the second projection having a groove;

wherein the tongue of the backing strip is located inside the groove of the cover strip and the tab of the cover strip located inside the slot of the backing strip.

2. The interlocking decorative trim system of claim 1, further comprising a flange extending from the top of the cover strip.

3. The interlocking decorative trim system of claim 2, wherein the flange and the top of the cover strip define a cavity sized to receive siding.

4. The interlocking decorative trim system of claim 2, wherein the flange has a plurality of apertures to allow the cover strip to the fastened to a wall.

5. The interlocking decorative trim system of claim 2, wherein the flange is made from rigid PVC and the cover strip is made from cellular PVC.

6. The interlocking decorative trim system of claim 5, wherein the flange and the top of the cover strip define a cavity sized to receive siding.

7. The interlocking decorative trim system of claim 5, wherein the flange has a plurality of apertures to allow the cover strip to be fastened to a wall.

8. The interlocking decorative trim system of claim 1, wherein the tongue and the groove are sized such that a channel is formed between the tongue and the groove.

9. The interlocking decorative trim system of claim 1, wherein the at least one recess of the backing strip is sized and configured to accommodate a fastener such that the fastener does not extend out of the recess in a direction away from the front face of the backing strip.

10. The interlocking decorative trim system of claim 1, wherein the at least one recess of the backing strip is longitudinal and extends a length of the backing strip.

11. An interlocking decorative trim assembly comprising:

a first and a second backing strip;

a first and a second cover strip; and a right angle reinforcement; and wherein:

the first and second backing strip each has a top, a bottom, a first end, a second end, a back face, a front face, a tongue extending from the top, and a projection adjacent the bottom and extending away from the front face, the front face having at least one recess and the projection having a slot; and the first and second cover strip each has a top, a bottom, a first end, a second end, a front face, a back face, a tab extending from the bottom, and a second projection adjacent the top and extending away from the front face, the back face having at least one recess, and the second projection having a groove; wherein the right angled reinforcement is sized and configured to fit into at least one recess of a cover strip; and the tongue of the first backing strip is located inside the groove of the first cover strip and the tab of the first cover strip located inside the slot of the first backing strip; and the tongue of the second backing strip is located inside the groove of the second cover strip and the tab of the second cover strip located inside the slot of the second backing strip; and the first end of the first cover strip is located adjacent to the first end of the second cover strip and the first end of the first backing strip is located adjacent to the first end of the second backing strip; and a portion of the right angled reinforcement is located inside the at least one recess of the first cover strip and a portion of the right angled reinforcement is located inside the at least one recess of the second cover strip such that the first and second cover strip are held in a mated or substantially mated condition.

12. The interlocking decorative trim assembly of claim 11, wherein the at least one recess of the first and second backing strip are each sized and configured to accommodate a fastener such that the fastener does not extend out of the at least one recess in a direction away from a front face of a backing strip.

13. The interlocking decorative trim system of claim 11, wherein the at least one recess of the first and second backing strip are each longitudinal and extend a length of a backing strip.

14. An interlocking decorative trim assembly comprising:

a first, a second, and a third backing strip;

a first, a second, and a third cover strip; and a first and a second right angle reinforcement; wherein:

the first, second, and third backing strip each has a top, a bottom, a first end, a second end, a back face, a front face, a tongue extending from the top, and a projection adjacent the bottom and extending away from the front face, the front face having at least one recess and the projection having a slot;

the first, second, and third cover strip each has a top, a bottom, a first end, a second end, a front face, a back face, a tab extending from the bottom, and a second projection adjacent the top and extending away from the front face, the back face having at least one recess, and the second projection having a groove;

the first and second right angled reinforcement are each sized and configured to fit into at least one recess of a cover strip;

the tongue of the first backing strip is located inside the groove of the first cover strip and the tab of the first cover strip located inside the slot of the first backing strip;

the tongue of the second backing strip is located inside the groove of the second cover strip and the tab of the second cover strip located inside the slot of the second backing strip; and the tongue of the third backing strip is located inside the groove of the third cover strip and the tab of the third cover strip located inside the slot of the third backing strip;

the first end of the first cover strip is located adjacent to the first end of the second cover strip;

the first end of the first backing strip is located adjacent to the first end of the second backing strip;

the second end of the second cover strip is located adjacent to the first end of the third cover strip;

the second end of the second backing strip is located adjacent to the first end of the third backing strip;

a portion of the first right angled reinforcement is located inside the at least one recess of the first cover strip and a portion of the first right angled reinforcement is located inside the at least one recess of the second cover strip such that the first and second cover strip are held in a mated or substantially mated condition; and a portion of the second right angled reinforcement is located inside the at least one recess of the second cover strip and a portion of the second right angled reinforcement is located inside the at least one recess of the third cover strip such that the second and third cover strip are held in a mated or substantially mated condition.

15. The interlocking decorative trim system of claim 14, wherein the at least one recess of the first, second, and third backing strip are each sized and configured to accommodate a fastener such that the fastener does not extend out of the at least one recess in a direction away from a front face of a backing strip.

16. The interlocking decorative trim system of claim 14, wherein the at least one recess of the first, second, and third backing strip are each longitudinal and extend a length of a backing strip.

17. An interlocking decorative trim assembly comprising:

a first, a second, a third, and a fourth backing strip;

a first, a second, a third, and a fourth cover strip; and a first, a second, a third, and a fourth right angle reinforcement; wherein:

the first, second, third, and fourth backing strip each have a top, a bottom, a first end, a second end, a back face, a front face, a tongue extending from the top, and a projection adjacent the bottom and extending away from the front face, the front face having at least one recess and the projection having a slot;

the first, second, third, and fourth cover strip each has a top, a bottom, a first end, a second end, a front face, a back face, a tab extending from the bottom, and a second projection adjacent the top and extending away from the front face, the back face having at least one recess, and the second projection having a groove;

the first, second, third, and fourth right angled reinforcement are each sized and configured to fit into the at least one recess of a cover strip;

the tongue of the first backing strip is located inside the groove of the first cover strip and the tab of the first cover strip located inside the slot of the first backing strip;

the tongue of the second backing strip is located inside the groove of the second cover strip and the tab of the second cover strip located inside the slot of the second backing strip;

the tongue of the third backing strip is located inside the groove of the third cover strip and the tab of the third cover strip located inside the slot of the third backing strip;

the tongue of the fourth backing strip is located inside the groove of the fourth cover strip and the tab of the fourth cover strip located inside the slot of the fourth backing strip;

the first end of the first cover strip is located adjacent to the first end of the second cover strip and the first end of the first backing strip is located adjacent to the first end of the second backing strip;

the second end of the second cover strip is located adjacent to the first end of the third cover strip and the second end of the second backing strip is located adjacent to the first end of the third backing strip;

the second end of the third cover strip is located adjacent to the second end of the fourth cover strip and the second end of the third backing strip is located adjacent to the second end of the fourth backing strip;

the first end of the fourth cover strip is located adjacent to the second end of the first cover strip and the first end of the fourth backing strip is located adjacent to the second end of the first backing strip:

a portion of the first right angled reinforcement is located inside the at least one recess of the first cover strip adjacent the first end and a portion of the first right angled reinforcement is located inside the at least one recess of the second cover strip adjacent the first end such that the first and second cover strip are held in a mated or substantially mated condition;

a portion of the second right angled reinforcement is located inside the at least one recess of the second cover strip adjacent the second end and a portion of the second right angled reinforcement is located inside the at least one recess of the third cover strip adjacent the first end such that the second and third cover strip are held in a mated or substantially mated condition;

a portion of the third right angled reinforcement is located inside the at least one recess of the third cover strip adjacent the second end and a portion of the third right angled reinforcement is located inside the at least one recess of the fourth cover strip adjacent the second end such that the third and fourth cover strip are held in a mated or substantially mated condition; and a portion of the fourth right angled reinforcement is located inside the at least one recess of the fourth cover strip adjacent the first end and a portion of the fourth right angled reinforcement is located inside the at least one recess of the first cover strip adjacent the second end such that the fourth and first cover strip are held in a mated or substantially mated condition.

18. The interlocking decorative trim system of claim 17, wherein the at least one recess of the first, second, third, and fourth backing strip are each sized and configured to accommodate a fastener such that the fastener does not extend out of the at least one recess in a direction away from a front face of a backing strip.

19. The interlocking decorative trim system of claim 17, wherein the at least one recess of the first, second, third, and fourth backing strip are each longitudinal and extend a length of a backing strip.

* * * * *